United States Patent [19]

Getchell

[11] 3,944,388

[45] Mar. 16, 1976

[54] METHOD FOR IMPROVING ABRASION AND WEAR RESISTANCE OF EDGE PORTIONS OF DURABLE PRESS GARMENTS

[75] Inventor: Nelson F. Getchell, Great Falls, Va.

[73] Assignee: Cotton Incorporated, New York, N.Y.

[22] Filed: Oct. 3, 1973

[21] Appl. No.: 403,080

[52] U.S. Cl. ..... 8/116.4; 2/243 A; 8/115; 38/144

[51] Int. Cl.[2] ..... D06Q 1/02; D06M 1/00

[58] Field of Search ..... 8/115; 38/144; 2/243

[56] References Cited

UNITED STATES PATENTS

| | | | |
|---|---|---|---|
| 2,531,814 | 11/1950 | Heberlein | 8/115 |
| 2,776,868 | 1/1957 | Russell et al. | 8/114.5 |
| 3,660,013 | 5/1972 | Payet et al. | 8/116.4 |

FOREIGN PATENTS OR APPLICATIONS

| | | |
|---|---|---|
| 630,172 | 10/1949 | United Kingdom |

*Primary Examiner*—Richard B. Turer

*Attorney, Agent, or Firm*—Burns, Doane, Swecker & Mathis

[57] ABSTRACT

The abrasion and wear resistance of edge portions of garments made of cellulose-containing fabrics which have durable press properties imparted thereto by exposing the garments to vapors containing formaldehyde and sulfur dioxide and curing them are improved by selectively applying a barrier to the edge portions prior to exposure of the garments to the reactive vapors. This barrier may be physical in nature, such as a plastic resin film applied to the edges to be protected, or it may be a catalyst poison or inactivator which prevents the crosslinking reaction from taking place in the protected portions of the fabric.

9 Claims, No Drawings

METHOD FOR IMPROVING ABRASION AND WEAR RESISTANCE OF EDGE PORTIONS OF DURABLE PRESS GARMENTS

BACKGROUND OF THE INVENTION

It is well known that cellulose-containing fabrics, such as those made of cotton, linen, or regenerated cellulose or blends thereof, suffer from a disadvantage in that they wrinkle on washing and drying or during wear. Over the past several decades many procedures were developed in efforts to remedy this defect. These efforts resulted in processes using hundreds of different types of chemicals to treat the cellulose fabrics in order to create what has become known as "wash-and-wear" and, more recently, as "durable press" materials. At the present time, most of these processes involve a crosslinking reaction between adjacent cellulose molecules. This is, in general, accomplished by the use of reagents which cause the reaction between free hydroxyl groups in the repeating anhydroglucose groups in the cellulose unit through covalent linkages. Among these reagents are polyfunctional compounds which react with the hydroxyl groups to form bridges between adjacent cellulose molecules. Illustrative of such crosslinking agents are formaldehyde or formaldehyde liberating agents, and N-methylol compounds such as dimethylol urea, tetramethylol acetylene diurea, 1,3-dimethylol-4,5-dihydroxy ethylene urea, dimethylol ethylene urea, methylol triazones, melamine formaldehyde, and the like.

The crosslinks produced by these materials permit a certain amount of slipping between the cellulose molecules under stress but tend to return them substantially to their initial relationships when the outside stresses are removed. Thus, by introducing these crosslinkages into a cellulose fabric, a durable press is obtained. However, although some of these processes produce satisfactory commercial articles, the crosslinking process results in an attendant loss of tensile strength and abrasion resistance. Thus, durable press garments produced from such treated fabrics have a tendency to wear and fray particularly at the edges, such as the cuffs, collar lines and collar tips which are most exposed to friction in the course of being worn or in the course of mechanical laundering and drying.

Of the crosslinking agents mentioned above, formaldehyde is particularly attractive for a variety of reasons, especially where the durable press treatment is to be applied to completed garments. For this reason, many efforts have been directed to develop durable press processes in which vaporized formaldehyde can be used as the crosslinking agent. Among those recently developed for commercial use is one disclosed in U.S. Pat. No. 3,706,526 (Swidler et al). According to this process, cellulosic materials are exposed to hot vapors of formaldehyde and sulfur dioxide in the presence of moisture and cured to improve their dimensional stability, wrinkle resistance, crease retention, and smooth drying characteristics. This process is particularly advantageous for treating fabricated garments, such as knit or woven shirts, blouses, or trousers, to impart durable press properties thereto. Another important result of the Swidler et al process is that it significantly reduces shrinkage; more so, in fact, than the durable press "resin finishes". However, like other kinds of durable press garments, the garments so treated suffer from the tendency of the edges of cuffs or collar tips or other edge portions to fray much sooner than the rest of the fabric.

Many attempts have been made to remedy this type of defect. Thus, for example, U.S. Pat. No. 3,264,054 (Reinhardt et al) discloses a procedure whereby a softener for the material is applied to the fabric. According to this process, an aqueous emulsion of finely divided polyethylene resin is applied uniformly to a cotton material prior to treatment with gaseous formaldehyde and hydrogen chloride. This was found to result in a higher tearing strength and a higher wet and dry crease recovery angle than a cotton fabric similarly treated with formaldehyde without prior application of the polyethylene softener. However, this process suffers from the defect that it results in a product having poor resistance to laundering, while not overcoming the fabric-weakening effect of the hydrogen chloride.

Since the majority of the known durable press treatments require the presence of a catalyst and a relatively high treating temperature to cause the desired crosslinking reaction to proceed to the required extent, another attempted approach has been to control the degree of contact of the catalyst with the fabric. The durable press finish in the conventional processes for producing wrinkle resistant fabrics penetrates the entire fabric, causing crosslinking of the cellulose molecules substantially throughout the fibrous structure when the treated fabric is cured. Since the reduced abrasion resistance as compared with uncured cotton fabrics is due largely to crosslinked cellulose in the fibers located at the fabric surface, one process for remedying this defect, according to U.S. Pat. No. 3,402,988 (Reeves et al), has been to apply a catalyst deactivator to the surface of a fabric which had been impregnated with a crosslinking agent, but prior to the curing of the latter. Although this process is in general successful in improving the abrasion resistance of the durable press fabrics, it is difficult to apply without seriously impairing the desired durable press effect and is applicable only to those processes where the crosslinking agent can be applied to the fabric mixed with the required catalyst and then dried prior to the finishing step. Thus, it must be possible to interpose a step of applying a catalyst deactivator to the fabric surface between the drying step and the high temperature curing step. For this reason, it is effectively applicable only to those systems using, for example, a solid catalyst such as zinc chloride or other non-volatile salt and a nonvolatile crosslinking agent such as dimethylol urea, dimethylol ethylene urea, and the like, which can be applied in aqueous solutions or emulsions.

Another proposed method for improving the abrasion resistance of durable press fabrics is that disclosed in U.S. Pat. No. 3,457,024 (Chipalkatti et al) in which the cellulose-containing textile material is first reacted with an ester of 1,3-dihalopropanol-2 or 1,2-dihalopropanol-3 prior to treatment with the crosslinking agent. The reaction of the ester with the cellulosic textile material is carried out in the presence of an 18–20 percent aqueous sodium hydroxide solution in the slack condition, and the thus reacted cellulosic textile is then washed free of alkali and further reacted with a finishing agent, with or without prior drying. During the washingoff of the alkali, or during any of the subsequent operations, the cellulosic textile material must be stretched nearly to its original dimensions. Although this procedure will improve the abrasion resistance of the fabric, it requires a number of additional steps and additional equipment which cause complications and increase the cost of the finished product.

Still another proposed process for improving the abrasion resistance of crosslinked cellulose products is disclosed in U.S. Pat. No. 3,528,762 (Lauchenauer). According to this process, the crosslinking agent and the catalyst are applied first to the fabric. The latter is then subjected to an atmosphere containing a catalyst poison. This produces a fabric in which the cellulose fibers at the surface are crosslinked to a lesser degree than the fibers in the interior of the fabric. Here again, the crosslinking agent and catalyst must be such that they can be applied to the fabric without curing so that the fabric containing them may be cured while being subjected to the atmosphere in which a catalyst poison is present.

Still another proposed method for improving the abrasion resistance of fabrics particularly on the creases of trouser cuffs, has been to apply a permanent wear-resistant edge coating which has greater abrasion resistance than the fabric of which the cuffs are made. Such a process is disclosed in U.S. Pat. No. 3,166,765 (Getchell).

SUMMARY OF THE INVENTION

As already mentioned above, one of the recent processes for producing wrinkle resistant, durable press fabrics is the vapor-phase treatment of cellulosic textiles with formaldehyde and sulfur dioxide in the presence of moisture, as disclosed by Swidler et al in U.S. Pat. No. 3,706,526. A batch operation which is based on the Swidler et al process and is illustrative of a commercial embodiment thereof is disclosed by Payet et al in U.S. Pat. No. 3,660,013, with particular reference to the treatment of garments.

It is a primary object of the present invention to provide a practical method for improving the edge wear resistance of garments fabricated from cellulosic textiles to which durable press properties are imparted according to the process of the just mentioned Swidler et al patent. Another object of this invention is to improve the edge wear of crosslinked cellulosic fabrics by a process which is easily applicable to fabricated garments and does not involve any difficulty controllable chemical treatment of the fabric either before or after the cure which imparts the desired durable press properties.

These and other objects will become more fully apparent to those skilled in this art from the description of the invention below.

In accordance with the present invention it has surprisingly been found that the edge wear resistance of garments made from woven or knitted cellulose-containing fabrics treated substantially as disclosed in the above-mentioned Swidler et al patent can be increased by applying to the surface of the wear susceptible edges a barrier of a material which is capable of preventing contact of at least one of the several catalyst forming components of the vapor with the garment. The latter is then exposed to the formaldehyde-sulfur dioxide vapors as disclosed in the Swidler et al patent, after which the barrier material is removed. In one alternative, the formaldehyde crosslinking agent is applied to the fabric initially and the completed garment after application of the barrier to the wear susceptible portions thereof may then be exposed to a vapor-phase catalyst and cured in the absence of any additional application of crosslinking agent. In another alternative, the surface fibers of the wear-susceptible edges of a dry garment are treated with a water repellent agent prior to exposure to the formaldehydesulfur dioxide vapor mixture. Since moisture (introduced into the fabric by prior wetting or as steam in the formaldehyde-sulfur dioxide vapor mixture) is required to enable the sulfur dioxide and formaldehyde to form the required strong sulfonic acid catalyst, the presence of the water repellent agent on the surface fibers of the edge portions prevents formation of the acid conditions which are requisite to catalyze crosslinking of the cellulose molecules in the surface fibers.

The expedient of using a water repellent agent to prevent activation of the crosslinking catalyst can also be applied to the older processes in which a metal salt catalyst is used. Reference here is to those latent catalysts such as zinc nitrate, magnesium chloride, and the many others with which those skilled in the art are familiar. Thus, it is a known procedure to pretreat either a fabric or a prepared garment with a latent acid catalyst, subsequently to apply a crosslinking agent, and then cure. In this procedure, it is merely necessary, after the latent acid catalyst has been installed in a finished garment and dried, to apply the water repellent agent to the edge portions, such as the edges of collars and cuffs, prior to exposure to moist formaldehyde vapors.

Regardless of the just discussed alternatives, the resulting product is one in which the cellulose fibers in the edge portions of the fabric are in a substantially uncrosslinked state. The locally applied material may be a physical barrier only or it may act chemically as a catalyst inactivator or as an inhibitor in the selected portions to which it has been applied. In a preferred form of the invention, the barrier is an impervious coherent resin film which is applied to the edges and adjacent areas of a garment. The film may be applied in the form of small, closely fitting plastic envelopes or opposed pairs of plastic strips or folded sheets which may be fastened to the fabric edges by small clothespins or clips. The garment is then treated according to the process disclosed in the Swidler et al patent and the film then removed. Any thin, flexible film can be used for this purpose as long as it will fit tightly to the surface of the fabric so as to protect it against access of at least the sulfur dioxide vapor and will not react substantially with the treating atmosphere so as to discolor or otherwise impair the appearance or strength of the fabric. A vinylidene chloride polymer, commercially available as "Saran Wrap", is preferred. However, thin sheets or films composed of polyethylene, polypropylene, vinylchloride-vinyl acetate, copolymers, various silicone compositions, natural or synthetic mica paper, thin sheets of tin or lead, and the like are also satisfactory. As catalyst inhibitors, any alkaline material which is not volatile at the treating temperatures and will react with the acidic sulfur dioxide can be used. A 10 percent trisodium phosphate aqueous solution has been found satisfactory for this purpose. Where a water repellent agent is used to prevent excess moisture to the surface cellulose fibers, any of the known, commercially available materials can be employed. Among these are the silicones, long chain quarternary pyridinium compounds (such as those used in the "Zelan" water repellent finish), wax emulsions containing aluminum or zirconium salts, and the like water repellent compositions which can be applied in the form of aqueous solutions or emulsions and with which those skilled in the fabric finishing art are well familiar. If desired, the water repellent agent can advantageously be left in place after the garment has been subjected to the cross-linking treatment.

DESCRIPTION OF SPECIFIC EMBODIMENTS

EXAMPLE I

A piece of "Saran" film was wrapped around the collar tips of a cotton knit shirt and fastened there by means of a small clothespin. The shirt was then treated with formaldehyde and sulfur dioxide according to the process disclosed in U.S. Pat. No. 3,660,013 and durable press properties were thus imparted to it. The film was removed from the collar tips and the shirt subjected to 15 wash-tumble dry laundering cycles at 140°F. Where in the case of a control shirt wear at the collar tips became noticeable after nine cycles, the shirt treated in accordance with the present invention showed no wear after 15 cycles.

EXAMPLE II

A 10 percent aqueous solution of trisodium phosphate was brushed on the collar tips of a cotton shirt like that used in Example I. After drying, durable press properties were imparted to the shirt in the same manner as that described in Example I. After this treatment, the shirt was subjected to 30 cycles of washing at 140°F. First signs of wear appeared on the underside of the collar points after 21 such wash-dry cycles but the tips themselves became so visibly worn open only at the end of 30 cycles.

The results of the above-described treatments are more fully described in Table 1, below. As used here, the term points refers to the two triangular sections of a collar and the term tips refers to the bottom end of the points.

TABLE 1

Laundry Abrasion of Collar Tips on Cotton Knit Shirts after Formaldehyde-$SO_2$ Treatment

| Laundering Cycles | Collar Tip Treatment Prior to Vapor Phase: None | Saran Wrap | 10% Trisodium Phosphate |
|---|---|---|---|
| 9 | wear at right collar tip starting | — | — |
| 10 | wear at left collar tip starting | — | — |
| 11 | — | — | — |
| 12 | — | tips intact but curled under | — |
| 13 | — | — | — |
| 15 | both tips worn open, no curl | no wear but tips very curled | some curl at both tips |
| 21 | — | — | first sign of wear on underside of collar points, tips intact but curled under |
| 30 | — | — | collar tips opening, the right more than left |

As can be seen from the table, the collars which have been wrapped in a plastic film did not show any wear even after 15 washing cycles. Those tips which were treated with the 10 percent trisodium phosphate solution only began to show wear after 21 cycles. In addition, there was some curling at the tips. However, because the tips in general have little resistance to deformation, a slight curling is not a serious objection and is offset by the improved abrasion resistance and general good appearance of the collar.

Although a 10 percent aqueous solution of trisodium phosphate (pH 12.5) was used in Example II, it will be obvious that any other similar aqueous alkali can be used in its place and that the optimum concentration or alkalinity can be readily determined in each case by simple preliminary screening tests.

Having described the invention, what is claimed is as follows:

1. In a process for improving the abrasion resistance of wear susceptible edge portions of a garment made of cellulose fiber-containing fabric wherein durable press properties are imparted to the fabric by exposure to formaldehyde vapor in the presence of moisture and a latent acid catalyst and heating the fabric to crosslink the cellulose fibers of said fabric, the improvement comprising:

applying a protective barrier selectively to the surface of said wear susceptible edge portions of the garment while leaving the main portion of the garment unprotected, said barrier being composed of a material capable of preventing substantial contact of at least one of the catalyst forming components with the said edge portions of the fabric before exposing the garment having the barrier applied thereto to an atmosphere containing formaldehyde and heat curing the fabric to provide a durable press garment having edge portions in which the cellulose fibers are not substantially reacted with formaldehyde while the cellulose fibers are substantially crosslinked with formaldehyde in the main portion of the garment.

2. In a process for improving the abrasion resistance of wear susceptible edge portions of a garment made of cellulose fiber-containing fabric wherein durable press properties are imparted to the fabric by exposure to formaldehyde vapor and sulfur dioxide in the presence of moisture and heating the fabric to crosslink the cellulose fibers of said fabric, the improvement comprising:

applying a protective barrier selectively to the surface of said wear susceptible edge portions of the garment while leaving the main portion of the garment unprotected, said barrier being composed of a material capable of preventing substantial contact of at least one of the catalyst forming components with the said edge portions of the fabric before exposing the garment having the barrier applied thereto an atmosphere containing formaldehyde and sulfur dioxide vapors and heat curing the fabric to provide a durable press garment having edge portions in which the cellulose fibers are not substantially reacted with formaldehyde while the cellulose fibers are substantially crosslinked with formaldehyde in the main portion of the garment.

3. The process as in claim 2 wherein the protective barrier is removed after heat-curing the fabric.

4. The process as in claim 3 wherein the protective barrier is a strip of an impervious resin sheet.

5. The process as in claim 3 wherein the protective barrier is a film of polyvinylidene chloride.

6. The process as in claim 3 wherein the protective barrier comprises a catalyst inactivator.

7. The process as in claim 3 wherein the barrier comprises trisodium phosphate applied locally to the said edge portions as a catalyst inactivator.

8. The process as in claim 2 wherein the protective barrier is a water repellent agent.

9. The process as in claim 1 wherein the latent acid catalyst is applied to the garment prior to exposure to formaldehyde vapors and wherein the protective barrier is a water repellent agent.

* * * * *